US009624633B1

(12) United States Patent
Judin

(10) Patent No.: US 9,624,633 B1
(45) Date of Patent: Apr. 18, 2017

(54) ROLLER ATTACHMENT FOR A PLOW BLADE

(71) Applicant: John S. Judin, Lowellville, OH (US)

(72) Inventor: John S. Judin, Lowellville, OH (US)

( * ) Notice: Subject to any disclaimer, the term of this patent is extended or adjusted under 35 U.S.C. 154(b) by 0 days.

(21) Appl. No.: 14/922,284

(22) Filed: Oct. 26, 2015

(51) Int. Cl.
*E02F 5/00* (2006.01)
*E01H 5/06* (2006.01)
*E02D 3/032* (2006.01)
*E01C 19/26* (2006.01)

(52) U.S. Cl.
CPC ..... *E01H 5/061* (2013.01); *E01C 19/266* (2013.01); *E02D 3/032* (2013.01)

(58) Field of Classification Search
CPC ..... E01C 19/22; E01C 19/26; E01C 19/266; E01C 19/482; E01C 19/285; E01C 19/38; E01C 19/268; E01H 5/066; E01H 5/061; E01H 5/062; E02F 3/962; E02F 5/223; E02D 3/026; E02D 3/032; A01B 13/16; A01B 29/045; A01B 59/048
USPC ..... 37/142.5, 266, 403–410; 404/122, 128, 404/129, 117, 121, 124, 127
See application file for complete search history.

(56) References Cited

U.S. PATENT DOCUMENTS 2,962,950 A 12/1960 Martin
3,873,228 A * 3/1975 Dunham ..... E01C 19/266 404/128
3,895,880 A 7/1975 Fink
3,932,052 A 1/1976 Fink
3,989,404 A * 11/1976 Burton ..... E01C 19/266 37/142.5
4,098,344 A * 7/1978 Johnson ..... E02D 3/026 172/170
4,193,710 A 3/1980 Pietrowski
4,307,524 A * 12/1981 Anderson ..... E01H 5/12 172/784
4,702,644 A 10/1987 Cioffi
4,867,606 A * 9/1989 Wright ..... E02D 3/046 172/40
5,062,228 A * 11/1991 Artzberger ..... E02D 3/02 37/407
5,553,380 A * 9/1996 Rice ..... A01D 34/62 29/895.2
D395,900 S * 7/1998 Shannon ..... D15/28
6,050,008 A * 4/2000 Doornek ..... E01H 5/066 280/86.1
6,171,020 B1 * 1/2001 Pikna ..... A01B 13/16 404/121
6,354,761 B1 3/2002 Clements
6,612,774 B1 * 9/2003 Dulin ..... E01C 19/266 404/104
8,668,405 B1 3/2014 Singleton
8,732,989 B1 * 5/2014 Turnbull ..... E01H 5/066 37/270

(Continued)

*Primary Examiner* — Robert Pezzuto
(74) *Attorney, Agent, or Firm* — Harpman & Harpman

(57) ABSTRACT

A detachable roller attachment for use on standard truck mounted plow blades that afford the positioning and use of a portable compaction roller assembly thereon. The roller attachment fittings are adjustable to correspond with the mounting fittings on a variety of plow blade size configurations. Hydraulic piston and cylinder plow blade activation and movement controls the roller attachment deployment and surface engagement for compaction rolling on any chosen surface.

6 Claims, 5 Drawing Sheets

(56) References Cited

U.S. PATENT DOCUMENTS

2009/0113864 A1* 5/2009 Eavenson, Sr. ..... A01D 43/00
56/1

* cited by examiner

ROLLER ATTACHMENT FOR A PLOW BLADE

BACKGROUND OF THE INVENTION

Technical Field

This invention relates to roller attachment for trucks allowing the addition of a portable compaction roller to be used thereon.

Description of Prior Art

Prior art devices of this type have provided a variety of truck-mounted rollers secured to trailing arms and mounting brackets mounted to the truck's frame and/or axle. See for examples U.S. Pat. Nos. 2,962,950, 3,895,880, 3,932,052, 4,193,710, 4,702,644, 6,354,761 and 8,668,405.

U.S. Pat. No. 2,962,950 discloses a combination truck and roller unit having an axle mounted roller with hydraulic piston and cylinder attached for deployment, lifting the axle of the truck.

U.S. Pat. No. 3,895,880 claims a roller attachment for trucks having a roller on a pair of hydraulic piston and cylinder assemblies, secured to the frame of a truck.

U.S. Pat. No. 3,932,052 illustrates a roller attachment for trucks having a roller assembly with a pair of hydraulic piston and cylinder assemblies that are secured to the truck. The roller is therefore raised and lowered to the contact surface thereby.

U.S. Pat. No. 4,193,710 discloses a truck-mounted roller on a pivot bracket secured to the truck frame. A hydraulic piston and cylinder assembly lifts and lowers the attached roller for surface engagement and use.

U.S. Pat. No. 4,702,644 claims an attachable truck-mounted roller with independent attached roller control pistons that engage and disengage the roller through the compaction surface.

U.S. Pat. No. 6,354,761 illustrates and claims a truck-mounted roller attachment used with a standard truck-mounted snow plow lift, once the snow plow is removed.

In U.S. Pat. No. 8,668,405 describes a road maintenance truck with selectively deployable road engagement roller and piston assemblies. The roller is mounted on a levered bracket attached to the frame, and a piston and cylinder raises and lowers the roller into contact use with the road surface.

SUMMARY OF THE INVENTION

The present invention is directed to vehicles, specifically truck-mounted roller attachments that provide for the mounting of roller assemblies to trucks. A roller attachment of the invention provides for the use of a portable roller assembly on a snow plow equipped truck, without removing the snow plow, thus providing a simple, quick and easy attachment of the roller for use. Adjustable mounting fittings on the roller adapt to different blade configurations and sizes, adaptably securing the roller directly to the blades surface. Control of the roller is achieved by existing blade hydraulics for lifting and lowering the blade and the roller which is positioned below the blade edge, allowing for direct surface engagement by the roller.

DETAILED DESCRIPTION OF THE INVENTION

Figure 1:
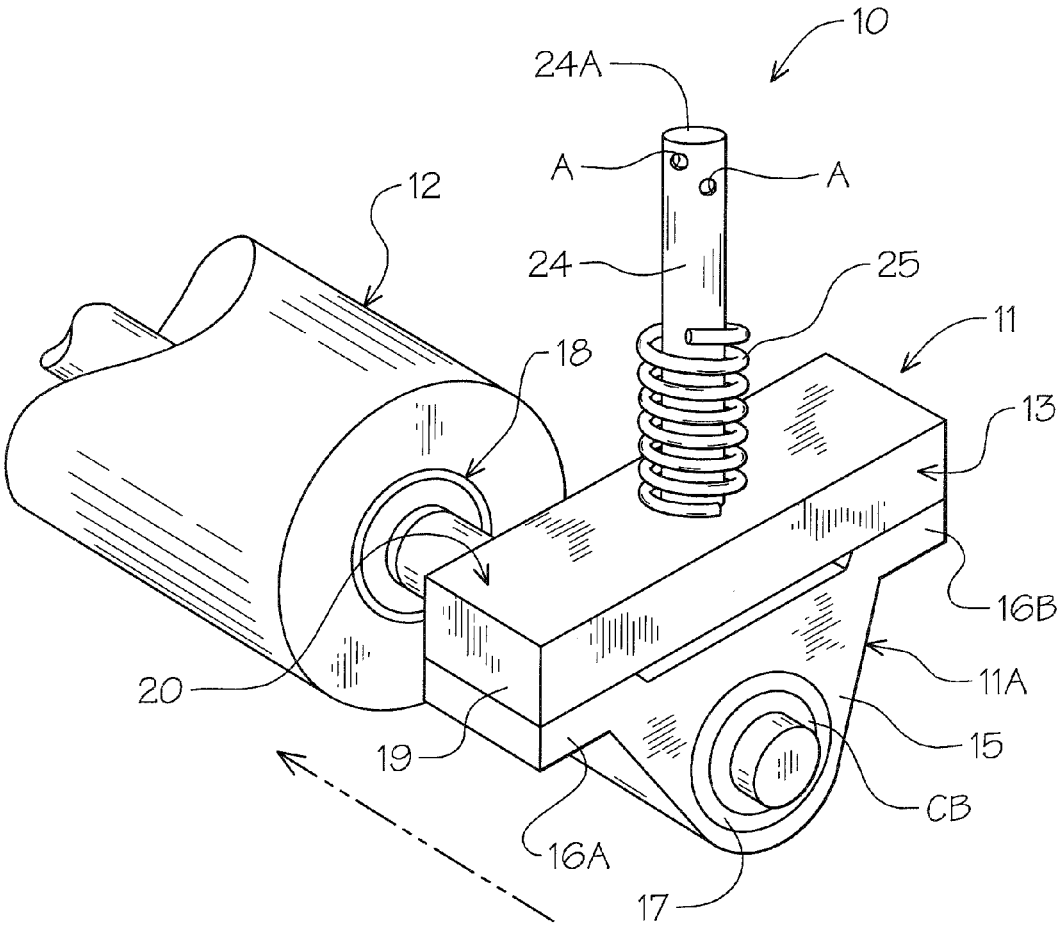
FIG. 1 is a perspective view of the roller attachment with portions broken away.
Figure 2:
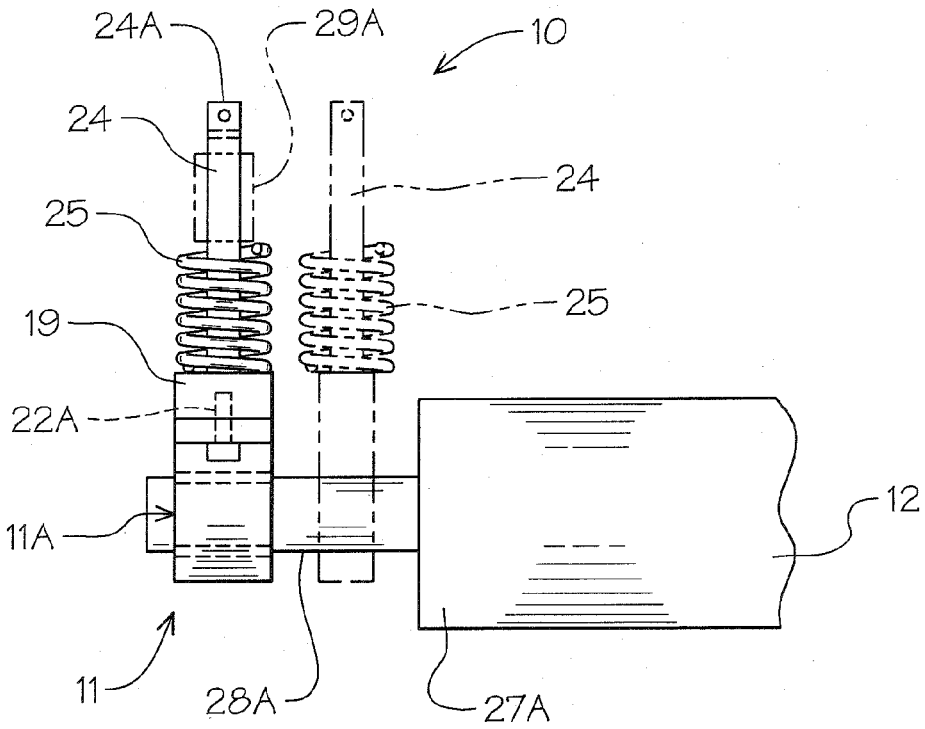
FIG. 2 is a front elevational view thereof with repositioning shown in broken lines.
Figure 3:
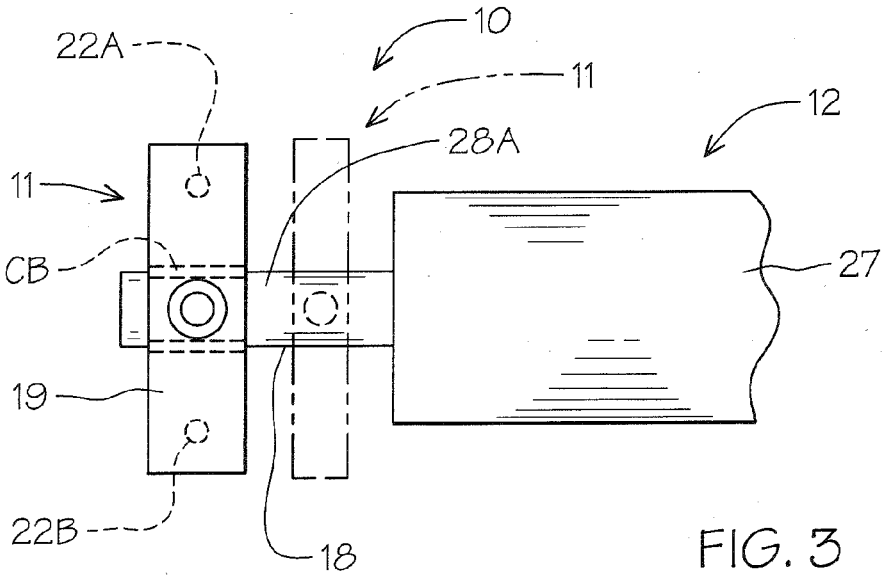
FIG. 3 is a top plan view thereof.
Figure 4:
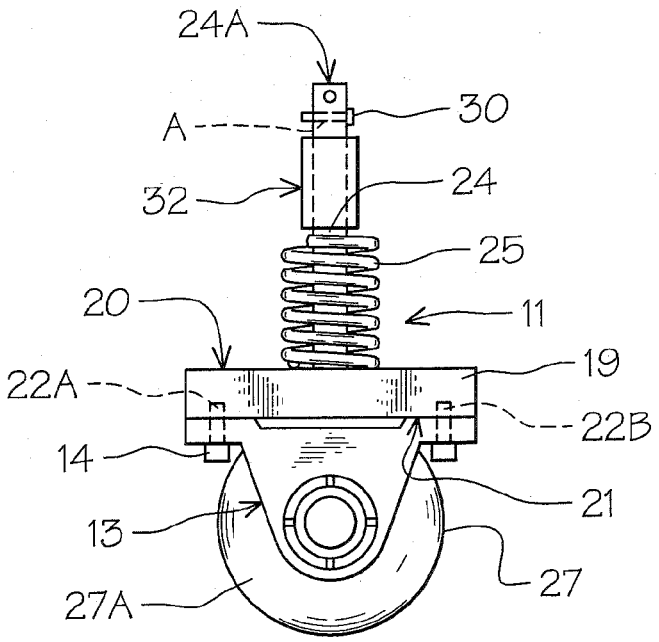
FIG. 4 is an exploded side elevational view of the roller attachment.

Referring to FIGS. 1-3 of the drawings, a compaction roller attachment 10 of the invention can be seen, having a pair of bearing block mounting assemblies 11, secured on the respective oppositely disposed free ends of a surface compaction roller 12. Each of the bearing block assemblies 11 has a bearing axle mount 11A, with a mounting block 13 secured thereto by fastener bolts 14, as best seen in FIG. 2 of the drawings.

The bearing axle mounts 11A are well-known in the art, having a cast metal support housing 15 with oppositely disposed aperture mounting tabs 16A and 16B, extending in space parallel orientation therefrom. A roller bearing assembly 17 is fitted within a central bore CB in the respective support housings 15, providing rotatable attachment to a roller axle assembly 18 that extends from oppositely disposed ends of the compaction roller 12. bearing axle mount 11A each have a rectangular block 19 with opposing upper and lower surfaces 20 and 21. The block 19 has a pair of longitudinally aligned threaded bores 22A and 22B, center transversely within the lower surface 21. The threaded bores 22A and 22B threadably receive the fastener bolts 14 through the perspective aperture mounting tabs 16A and 16B of the hereinbefore described bearing axle mounts 11A securing same thereto.

An attachment pin 24 extends from the upper surface 20 of the block 19 in vertical alignment with the attached bearing axle mount 11A, as best seen in FIG. 1 of the drawings.

The attachment pin 24 has a pair of transverse apertures A there through, adjacent to free end 24A.

Figure 6:
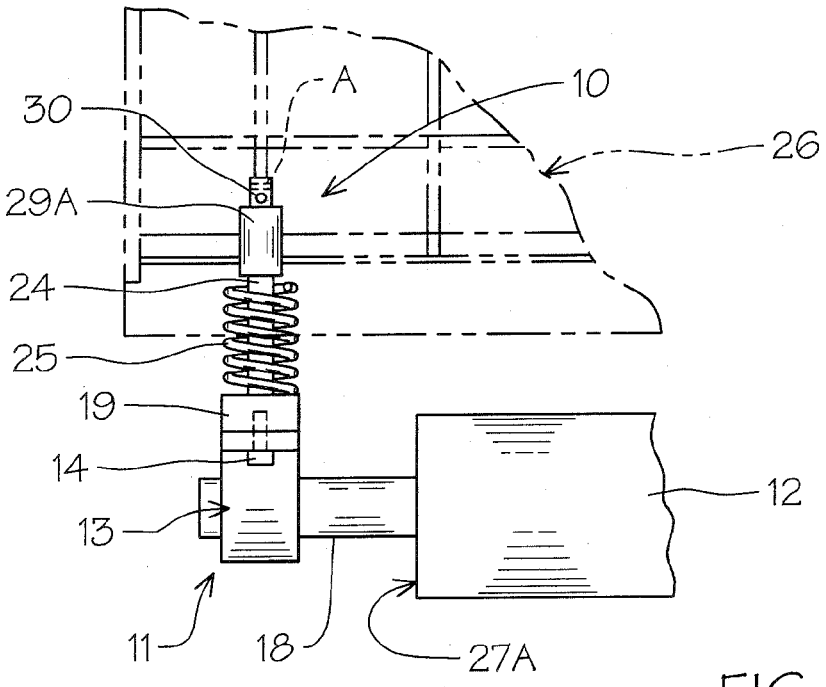
FIG. 6 is a partial front elevational view of the roller attachment positioned on a plow blade, shown in broken lines.

A coil spring configuration 25 is positioned on the pin 24 to provide spring resistance to the roller attachment 10 when mounted on a plow blade 26, shown graphically in broken lines in FIGS. 6, 7 and 8 of the drawings, as will be described hereinafter.

Figure 8:
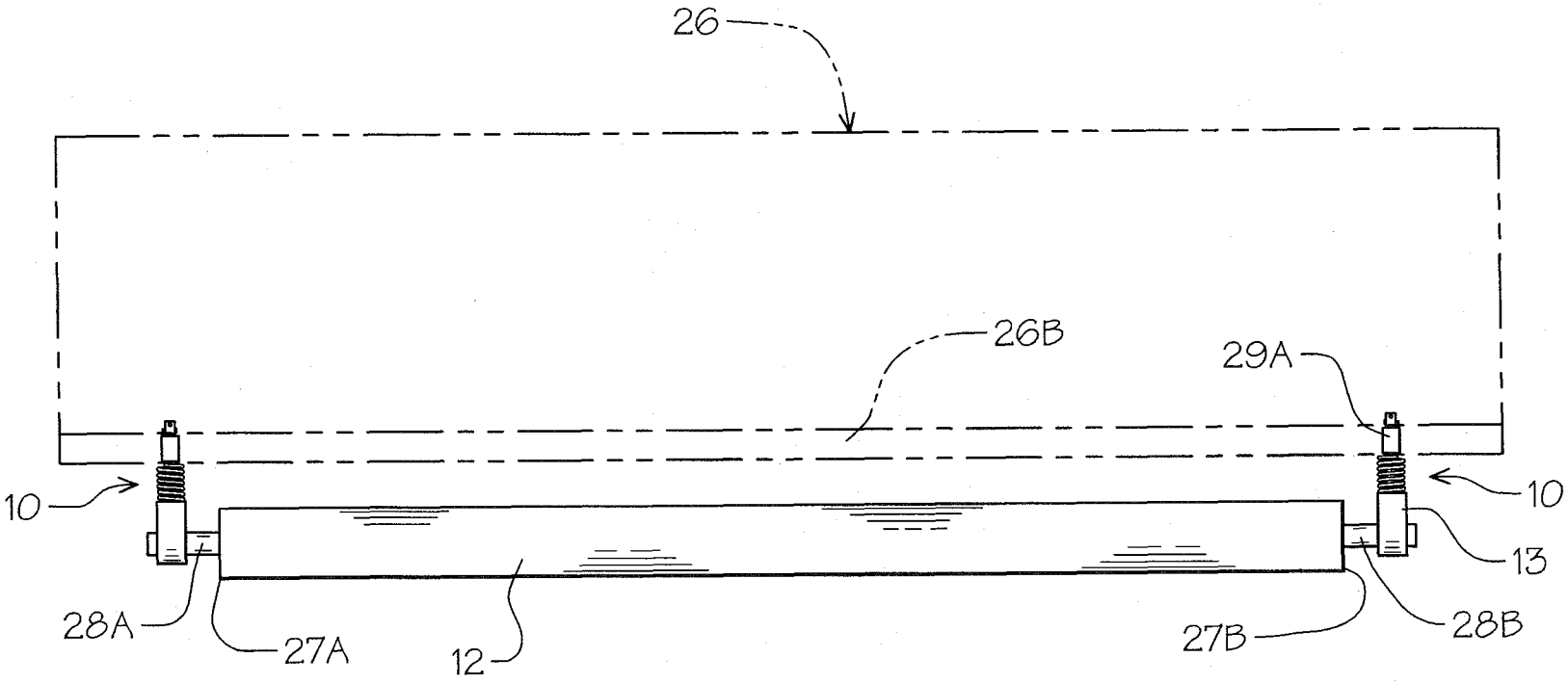
FIG. 8 is a front elevational view of the roller attachment shown in solid lines, mounted on a plow blade shown in broken lines.

The universal roller attachment 10 has a the compaction roller 12 secured on the roller axle 18 extending there through and outwardly at 28A and 28B on the compaction roller 12 respective ends 27A and 27B as seen in FIG. 8 of the drawings.

The respective axle end extensions 28A and 28B provide for adjustable mounting positioning there along for the respective bearing axle mounts 11A to accommodate different mounting points on a variety of truck blade configurations that are commercially available, shown in broken lines in FIGS. 2 and 3 of the drawings. It will be seen therefore that the bearing block mounting assemblies 11 can be positioned and secured anywhere on the respective axle end extensions 28A and 28B to accommodate as noted the different spacings required for securing to the blades.

Such plow blades 26 are designed for typically being attached to the front end of a vehicle, such as a pickup truck for snow removal and/or grading purposes, as well as commercial dump trucks (not shown) used by city, county and state road departments.

Figure 7:
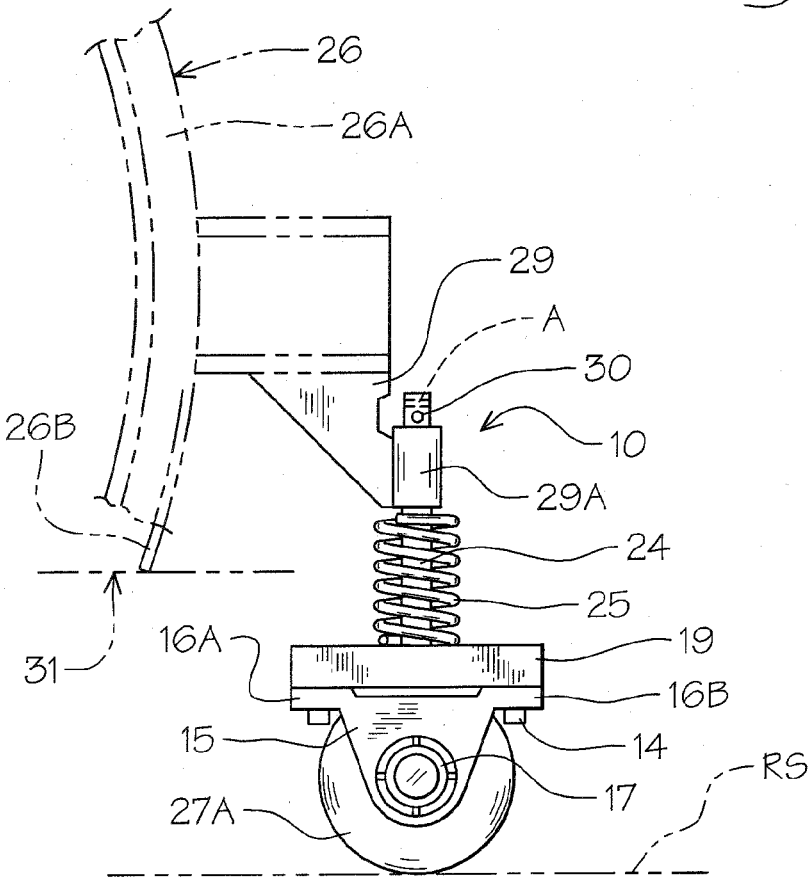
FIG. 7 is a side elevational view thereof.

Referring now to FIGS. 7, 8 of the drawings, the plow blade 26 can be seen in broken lines having a main blade portion 26A, blade edge 26B and a pair of skid shoe mounts 29 to space the blades from direct contact with the road surface RS.

It will be seen, therefore, that the roller attachment 10 of the invention, attachment pins 24 are adapted to fit directly into the skid shoe mounts 29, receiving sockets 29A, as illustrated best in FIG. 7 of the drawings. A retainment pin 30 is inserted through the selected pins aperture A moveably securing the roller attachment 10 directly to the plow blade 26 in spaced parallel orientation below the bottom planar edge 31 of the blade edge 26B.

The bearing block mounting assemblies 11 and attached compaction cylinder roller 12 are therefore resiliently engageable against a surface to be rolled, depending on the user application and venue of use so determined.

Figure 5:
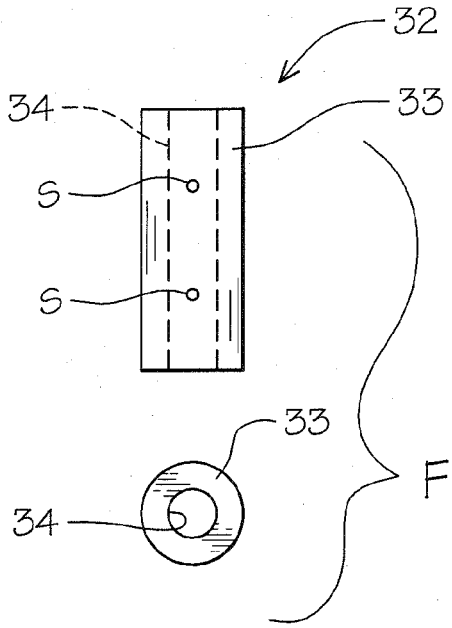
FIG. 5 is an enlarged composite side and top plan view of a roller mounting pin sleeve enlarger.

Referring to FIG. 5 of the drawings, the attachment pin sleeve 32 can be seen having a cylinder body member 33 with a central bore at 34 there through. The attachment pin sleeve bore 34 is of a dimension greater than then that of the known dimension of the attachment pin 24, allowing it to be selectively positioned there over, as seen in broken lines in FIG. 1 of the drawings, and secured thereto by a pair of longitudinally positioned set screws S. It will be from the above description that by utilization of the attachment pin sleeves 32 that the effective diameter of the attachment pin 24 can be increased to accommodate larger diameter skid shoe mounts, which may be present on different blade configurations (not shown).

It will thus be seen that a new and useful compaction roller attachment of the invention has been illustrated and described, allowing for simple attachment to existing plow blades without the removal from the vehicle. The roller attachment 10 is adjustable to accommodate a variety of different blade sizes in corresponding positional variations of their fixed skid shoe mounts. It will be apparent to those skilled in the art that various changes and modifications may be made thereto without departing from the spirit of the invention.

Therefore I claim:

1. A longitudinally adjustable roller attachment for a plow blade mounted on a vehicle for compacting and smoothing a surface comprises in combination, an elongated cylindrical roller, a pair of oppositely disposed roller axles of a known length extending integrally from said roller, a pair of bearing assemblies adjustably secured along said respective axles, each of said bearing assemblies comprises, an axle bearing and mounting block of a known transverse dimension less than that of said roller axles known length, an attachment pin upstanding from and secured to said respective mounting blocks, said attachment pin having a pair of vertically spaced right angular aligned transverse apertures therein, a pair of longitudinally spaced tubular pin receiving guide on said plow blade, a spring on a portion of said attachment pin registerable between said mounting block and said pin receiving guides, a retainment in registerable through one of said respective attachment sin transverse apertures therein, engageable on said tubular guides.

2. The roller attachment for a plow blade set forth in claim 1 wherein said attachment pins are in vertical alignment with said respective roller axles.

3. The roller attachment for a plow blade set forth in claim 1 wherein said spring is of a coil configuration.

4. The roller attachment for a plow blade set forth in claim 1 wherein said axles of said roller attachment are in spaced vertical relation to said plow blade.

5. The roller attachment for a plow blade set forth in claim 1 wherein said roller attachment is movable from a first non-engagement position to a second surface engagement position by said plow blade.

6. The roller attachment for a plow blade set forth in claim 1 wherein said roller and said axles extending integrally from said roller are made of metal.

* * * * *